US010147578B2

(12) United States Patent
Yoo et al.

(10) Patent No.: US 10,147,578 B2
(45) Date of Patent: Dec. 4, 2018

(54) MECHANISM COUPLING STRUCTURE OF MOLDED CASE CIRCUIT BREAKER

(71) Applicant: LSIS CO., LTD., Anyang-si, Gyeonggi-do (KR)

(72) Inventors: Sungrok Yoo, Anyang-si (KR); Kihwan Oh, Anyang-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 0 days.

(21) Appl. No.: 15/473,530

(22) Filed: Mar. 29, 2017

(65) Prior Publication Data

US 2018/0025876 A1 Jan. 25, 2018

(30) Foreign Application Priority Data

Jul. 22, 2016 (KR) ..... 10-2016-0093670

(51) Int. Cl.
*H01H 71/10* (2006.01)
*H01H 71/02* (2006.01)

(52) U.S. Cl.
CPC ..... *H01H 71/0207* (2013.01); *H01H 71/10* (2013.01); *H01H 71/1009* (2013.01); *H01H 71/0214* (2013.01)

(58) Field of Classification Search
CPC ..... H01H 71/1009; H01H 71/0214; H01H 71/0207; H01H 71/10
See application file for complete search history.

(56) References Cited

U.S. PATENT DOCUMENTS 4,737,603 A * 4/1988 Lycan ..... H01H 19/635 200/16 E
6,495,781 B2 * 12/2002 Greenberg ..... H01H 71/04 200/308
7,218,192 B2 * 5/2007 Stay ..... F16B 39/025 200/244

(Continued)

FOREIGN PATENT DOCUMENTS

CN 203644705 U 6/2014
CN 104576234 A 4/2015

(Continued)

OTHER PUBLICATIONS

Korean Intellectual Property Office Application No. 10-2016-0093670, Search report dated Sep. 21, 2016, 4 pages.

(Continued)

*Primary Examiner* — Felix O Figueroa
(74) *Attorney, Agent, or Firm* — K&L Gates LLP

(57) ABSTRACT

A mechanism coupling structure of a molded-case circuit breaker according to an embodiment of the present disclosure including a shaft to one side of which a movable contactor is coupled, and on a part of which a rotating pinhole is formed in a penetrating manner; a base assembly into which the shaft is rotatably accommodated and coupled, a switch mechanism coupled to an upper portion of the base assembly and exposed with a first lower link and a second lower link at a lower side thereof, and a rotating pin coupled in a penetrating manner to the first lower link, second lower link and rotating pinhole may be provided therein, wherein the rotating pin has a protruding portion for release prevention at one end thereof.

6 Claims, 9 Drawing Sheets

(56) References Cited

U.S. PATENT DOCUMENTS

| | | | | |
|---|---|---|---|---|
| 8,558,126 | B2 * | 10/2013 | An | H01H 71/1009 200/50.32 |
| 2013/0206558 | A1 | 8/2013 | Bunk | |

FOREIGN PATENT DOCUMENTS

| | | | |
|---|---|---|---|
| EP | 2023365 | A2 | 2/2009 |
| JP | H0575944 | | 10/1993 |
| JP | H09320442 | | 12/1997 |
| JP | 2000113798 | | 4/2000 |
| JP | 2003132776 | | 5/2003 |
| KR | 100662751 | | 12/2006 |
| KR | 100676967 | | 1/2007 |
| KR | 20080034605 | | 4/2008 |
| KR | 20100064243 | | 6/2010 |
| KR | 2020120001549 | | 3/2012 |
| KR | 20120004950 | | 7/2012 |

OTHER PUBLICATIONS

Korean Intellectual Property Office Application No. 10-2016-0093670, Office Action dated Jun. 23, 2017, 6 pages.
European Search Report for related European Application No. 17158437.8; report dated Oct. 11, 2017; (8 pages).
chinese Office Action for related Chinese Application No. 201710419628.9; action dated Aug. 23, 2018; (10 pages).

* cited by examiner

MECHANISM COUPLING STRUCTURE OF MOLDED CASE CIRCUIT BREAKER

CROSS-REFERENCE TO RELATED APPLICATIONS

Pursuant to 35 U.S.C. § 119(a), this application claims the benefit of earlier filing date and right of priority to Korean Patent Application No. 10-2016-0093670, filed on Jul. 22, 2016, the contents of which are all hereby incorporated by reference herein in its entirety.

BACKGROUND OF THE INVENTION

1. Field of the Invention

The present disclosure relates to a mechanism coupling structure of a molded-case circuit breaker, and more particularly, to a mechanism coupling structure of a molded-case circuit breaker for preventing a lower link from being released from a rotating pin by an arc pressure generated at the time of breaking.

2. Description of the Related Art

In general, Molded-Case Circuit Breaker (MCCB) is an electric device for automatically breaking a circuit in the event of an electrical overload or short circuit to protect the circuit and a load thereof. The molded-case circuit breaker may largely include a terminal portion that can be connected to a power side or load side, a contact portion including a fixed contactor and a movable contactor brought into contact with or separated from the fixed contactor to connect or separate the circuit thereto or therefrom, a switch mechanism configured to move the movable contactor to provide power required for the switching of the circuit, a trip portion configured to sense an overcurrent or a short-circuit current at the switch mechanism and the power side to induce a tripping operation of the switch mechanism, and an extinguisher for extinguishing an arc generated when an abnormal current is interrupted.

FIG. 1 illustrates a circuit breaker according to the prior art. Here, it is shown that molded-case circuit breaker is disassembled into a switch mechanism assembly 1, a base assembly 13, and a shaft assembly 16 in a state that an enclosure (case) is removed. Furthermore, FIG. 2 illustrates a front view of a switch mechanism of a molded-case circuit breaker according to the prior art.

Here, the switch mechanism is constituted by coupling a pair of side plates 11 with a toggle link mechanism, a release mechanism, and the like. The toggle link mechanism includes a switch lever 3 connected to a handle 2 to rotate, an upper link 6 and a lower link 4, connected to a link shaft 5, and provided between a movable contactor 7 and a latch 8. A release mechanism is connected to a lever-shaped latch 8 and a latch holder 9 to release the latch 8 in conjunction with the operation of an overcurrent releasing device (not shown). A main spring 10 is provided between the switch lever 3 and the link shaft 5 of the toggle link mechanism.

For a switching operation of the molded-case circuit breaker, when the handle 2 is moved to an OFF position in a closed (ON) state, the upper link 6 and lower link 4 of the toggle link mechanism receives an elastic force of the main spring 10 to rotate the shaft 16 while being bent in a "¬"-shape such that the movable contactor 7 is separated from the fixed contact (not shown) to open the circuit.

Furthermore, when an overcurrent flows during electrical conduction to operate an overcurrent release device (not shown), the release mechanism is activated by an output of the overcurrent release device to release the latch 8 held in the latch holder 9. As a result, the latch 8 rotates in a counter-clockwise direction, and the switch mechanism 8 performs a trip operation to switch the movable contact 7 to interrupt the current.

The mechanism coupling of a molded-case circuit breaker according to the prior art may couple the lower link 4 and the shaft assembly 16 of the mechanism with a single rotating pin 12 formed in a straight line shape. In other words, the operation of the lower link 4 rotates a shaft 17 by a rotating pinhole 18 formed on the shaft 17 and coupled in a penetrating manner to a pinhole 4*a* of the lower link 4. Here, the shaft assembly 16 is inserted and coupled into an accommodation space formed within the base assembly 13. Furthermore, the base assembly 13 is provided with a through hole 14 formed in an arc shape to form a space in which the rotating pin 12 can operate.

FIG. 3 is a side view in which a mechanism of a molded-case circuit breaker according to the related art is in a coupled state. It illustrates an ON state. FIG. 4 is a perspective view illustrating the lower link.

In an electrical conduction (ON) state as illustrated in FIG. 3, the lower link 4 moves downward to completely cover the through hole 14 of the base assembly 13. However, in the coupled state of such a mechanism, an internal pressure generated at the time of interruption may leak along a fine gap between the components to act on the lower link 4. Accordingly, the leaked pressure may act on the lower link 4 coupled to the rotating pin 12 with a force of pushing the lower link 4 in an outward direction, thereby causing a problem of releasing the lower link 4 from the rotating pin 12.

SUMMARY OF THE INVENTION

The present invention is contrived to solve the foregoing problem, and an aspect of the present invention is to provide a mechanism coupling structure of a molded-case circuit breaker for preventing a lower link from being released from a rotating pin by an arc pressure generated at the time of breaking.

A mechanism coupling structure of a molded-case circuit breaker according to an embodiment of the present disclosure including a shaft to one side of which a movable contactor is coupled, and on a part of which a rotating pinhole is formed in a penetrating manner; a base assembly into which the shaft is rotatably accommodated and coupled, a switch mechanism coupled to an upper portion of the base assembly and exposed with a first lower link and a second lower link at a lower side thereof, and a rotating pin coupled in a penetrating manner to the first lower link, second lower link and rotating pinhole may be provided therein, wherein the rotating pin has a protruding portion for release prevention at one end thereof.

Here, the rotating pin may include a first rotating pin having a first protruding portion and a second rotating pin having a second protruding portion.

Furthermore, the first rotating pin and second rotating pin may be symmetrically provided in such a manner that the first protruding portion and second protruding portion face outward.

Furthermore, the first protruding portion and second protruding portion may be brought into contact with the first lower link and second lower link.

Furthermore, an arc-shaped pinhole may be formed on the base assembly to expose the rotating pinhole when the shaft rotates, and a discharge groove configured to open a part of the pinhole may be formed at a lower portion of the first lower link and second lower link to discharge an arc pressure generated at the time of interruption to an outside thereof.

Furthermore, the discharge groove may be formed by cutting a part of the first lower link and second lower link.

Furthermore, a screw groove and a screw portion may be formed at body end portions of the first rotating pin and second rotating pin, respectively, to allow the first rotating pin and second rotating pin to be screw-coupled to each other.

In addition, threads may be formed on rotating pin coupling holes of the first lower link and second lower link, and the first rotating pin and second rotating pin may be configured with screws.

According to a mechanism coupling structure of a molded-case circuit breaker in accordance with an embodiment of the present disclosure, a part of an arc pressure generated at the time of interruption may be discharged through a discharge groove on a lower link, thereby having an effect of reducing a pressure acting on the lower link.

Furthermore, a rotating pin may have a protruding portion, thereby having an effect of preventing the rotating pin from being released from a lower link even when receiving a force due to an arc pressure.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Hereinafter, a preferred embodiment of the present invention will be described in detail with reference to the accompanying drawings to such an extent that the present invention can be easily implemented by a person having ordinary skill in the art to which the present invention pertains, but it does not mean that the technical concept and scope of the present invention are limited due to this.

Figure 1:
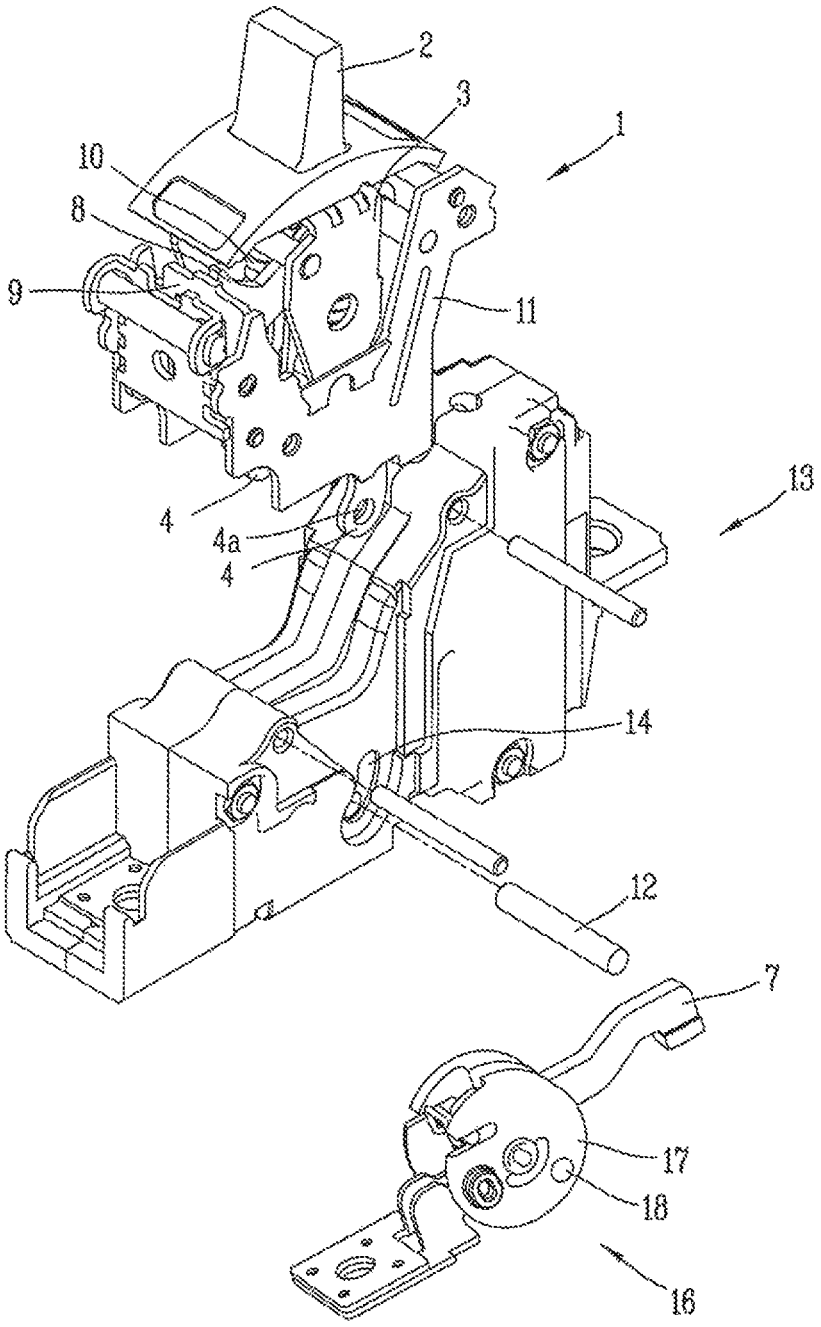
Fig. 1 Prior Art
FIG. 1 is a perspective view illustrating a mechanism coupling structure of a molded-case circuit breaker according to the related art.
Figure 2:
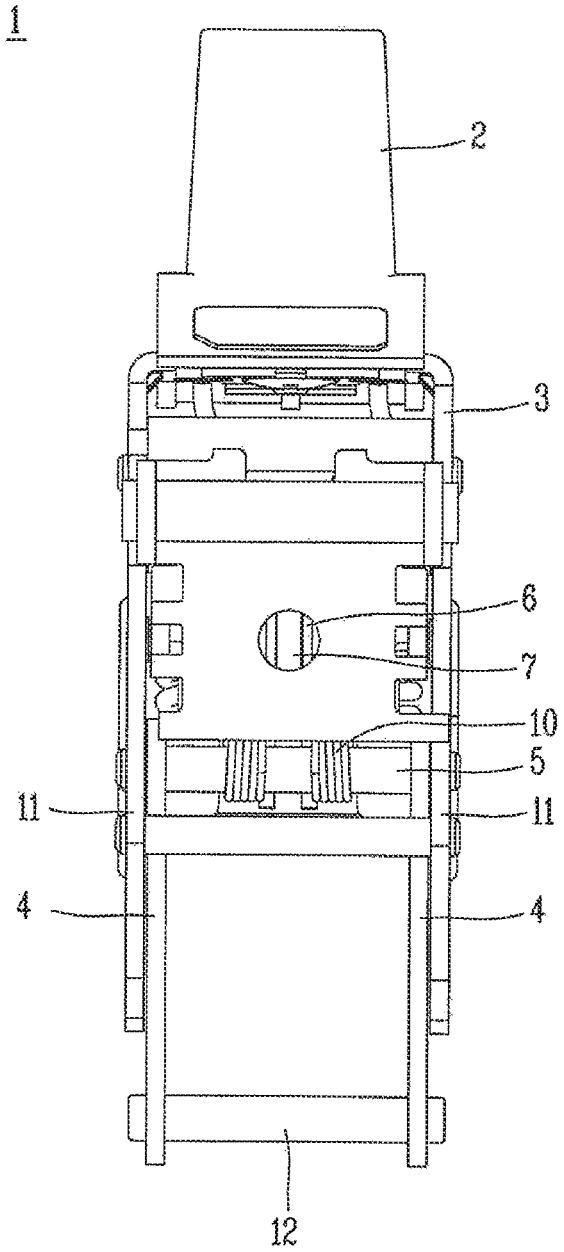
Fig. 2 Prior Art
FIG. 2 is a front view illustrating a switch mechanism of a molded-case circuit breaker according to the related art.
Figure 3:
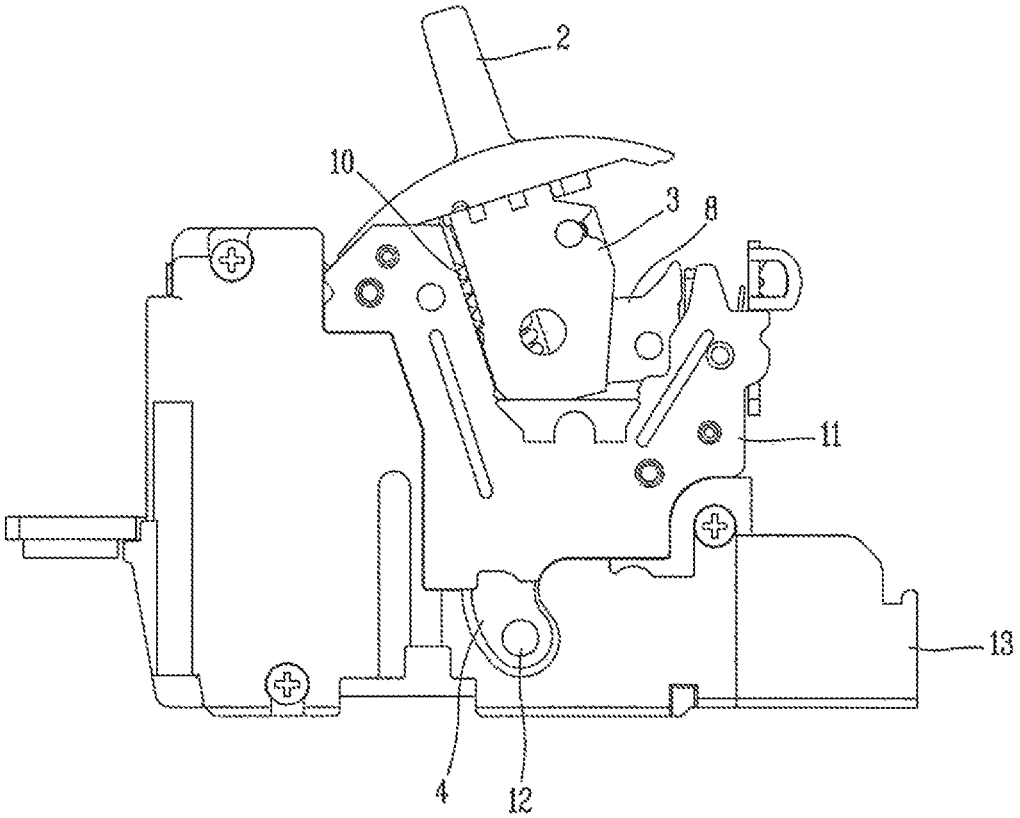
Fig. 3 Prior Art
FIG. 3 is a side view in which a mechanism of a molded-case circuit breaker according to the related art is in a coupled state.
Figure 4:
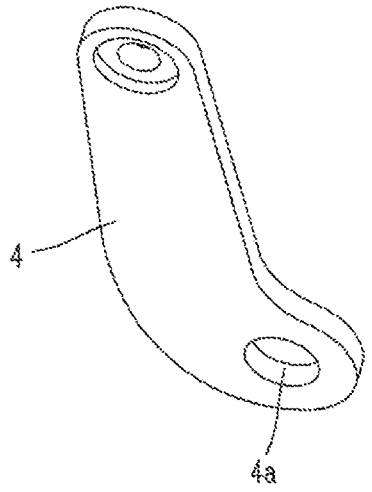
Fig. 4 Prior Art
FIG. 4 is a perspective view illustrating a lower link applied to a molded-case circuit breaker according to the related art.
Figure 5:
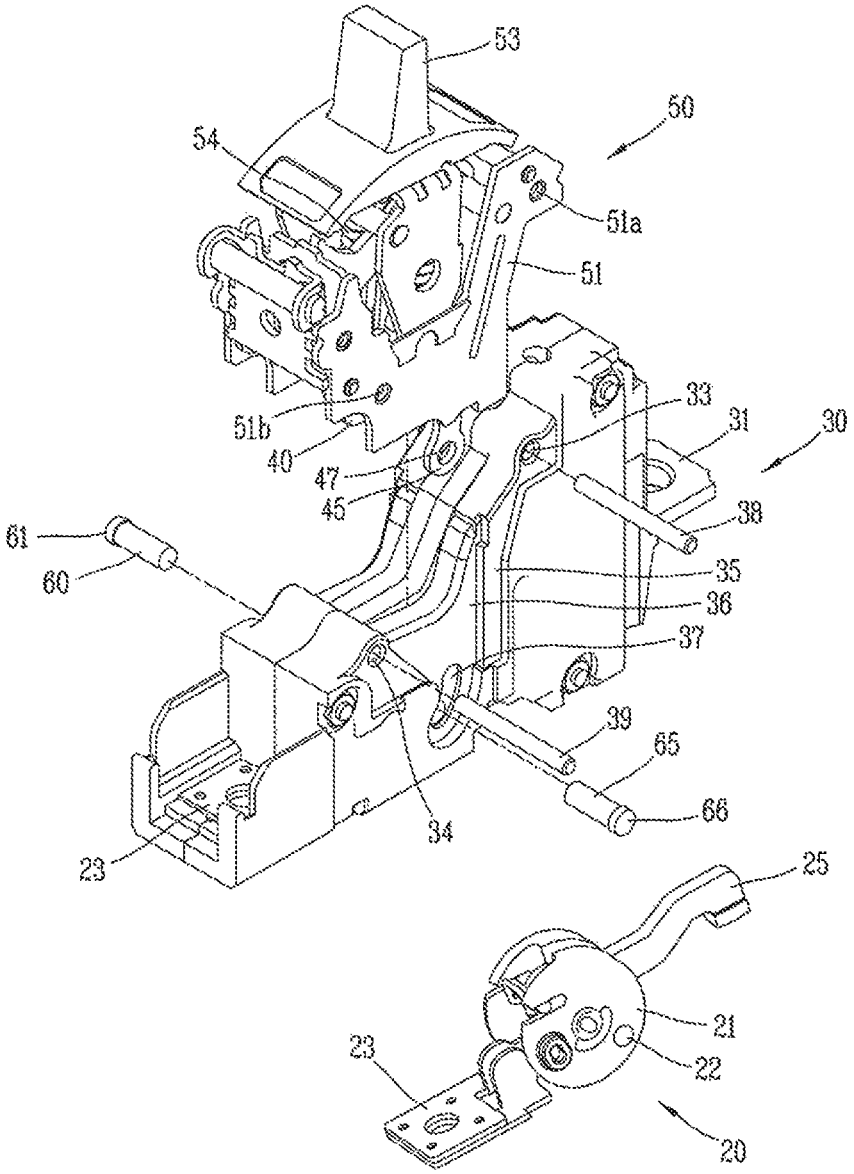
FIG. 5 is a perspective view illustrating a mechanism coupling structure of a molded-case circuit breaker according to an embodiment of the present disclosure.
Figure 6:
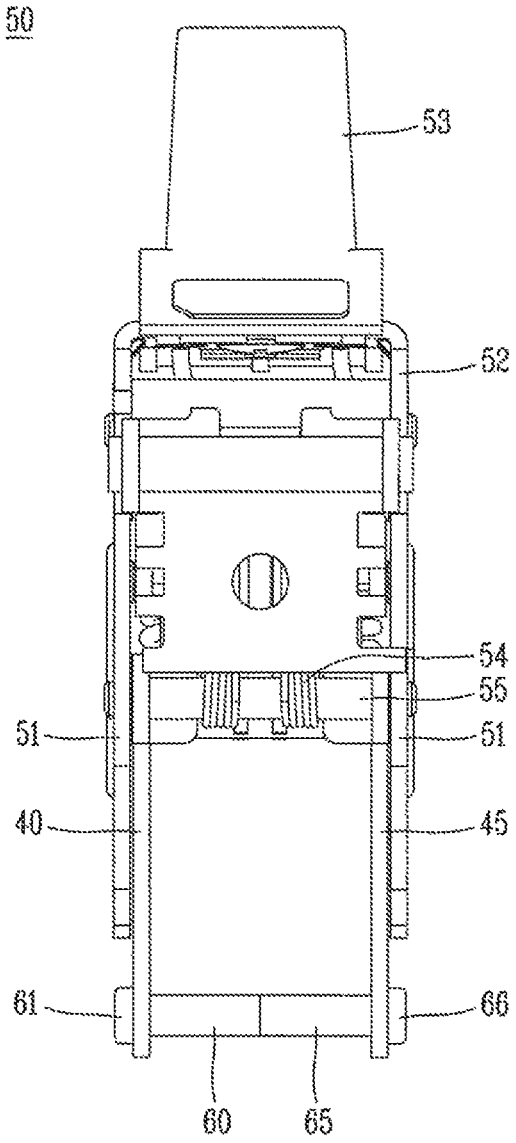
FIG. 6 is a front view illustrating a switch mechanism of a molded-case circuit breaker according to an embodiment of the present disclosure.
Figure 7:
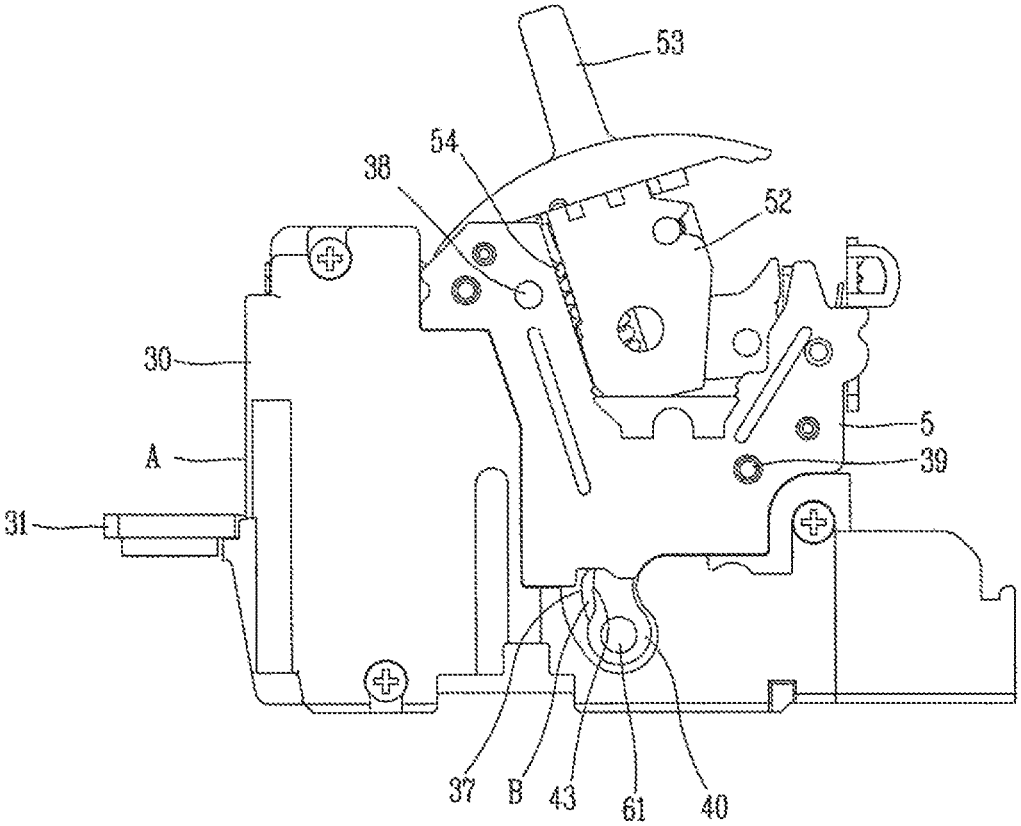
FIG. 7 is a side view in which a mechanism of a molded-case circuit breaker according to an embodiment of the present disclosure is in a coupled state.
Figure 8:
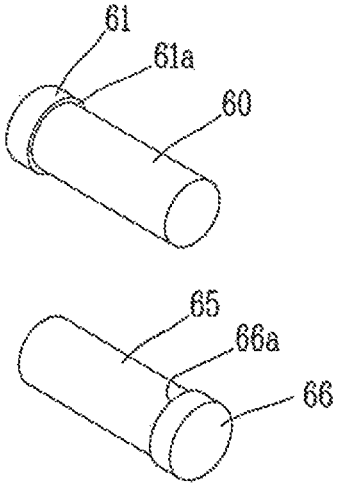
FIG. 8 is a perspective view illustrating a rotating pin applied to a mechanism of a molded-case circuit breaker according to an embodiment of the present disclosure.
Figure 9:
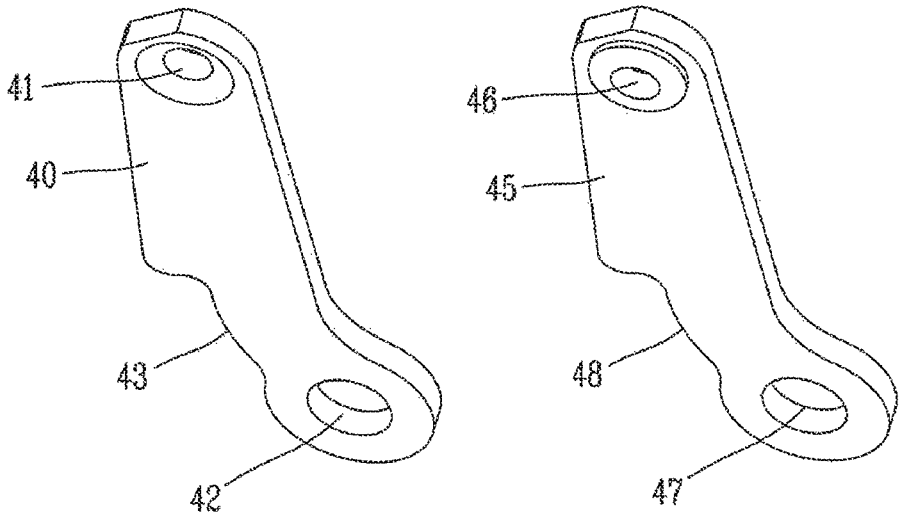
FIG. 9 is a perspective view illustrating a lower link applied to a molded-case circuit breaker according to an embodiment of the present disclosure.

FIG. 5 is a perspective view illustrating a mechanism coupling structure of a molded-case circuit breaker according to an embodiment of the present disclosure, and FIG. 6 is a front view illustrating a switch mechanism of a molded-case circuit breaker according to an embodiment of the present disclosure, and FIG. 7 is a side view in which a mechanism of a molded-case circuit breaker according to an embodiment of the present disclosure is in a coupled state, and FIGS. 8 and 9 are perspective views illustrating a rotating pin and a lower link applied to a mechanism of a molded-case circuit breaker according to an embodiment of the present disclosure. A mechanism coupling structure of a molded-case circuit breaker according to each embodiment of the present disclosure will be described in detail with reference to the accompanying drawings.

A mechanism coupling structure of a molded-case circuit breaker according to an embodiment of the present disclosure may include a shaft 21 to one side of which a movable contactor 25 is coupled, and on a part of which a rotating pinhole 22 is formed in a penetrating manner; a base assembly 30 into which the shaft 21 is rotatably accommodated and coupled, a switch mechanism 50 coupled to an upper portion of the base assembly 30 and exposed with a first lower link 40 and a second lower link 45 at a lower side thereof, and a rotating pin 60, 65 coupled in a penetrating manner to the first lower link 40, second lower link 45 and rotating pinhole 22, wherein the rotating pin 60, 65 has a protruding portion 61, 66 for release prevention at one end thereof.

FIGS. 5 and 7 illustrate an exploded perspective view and a coupled front view of a mechanism of a molded-case circuit breaker according to an embodiment of the present disclosure, and FIG. 6 illustrates a front view of a switch mechanism. The mechanism of the molded-case circuit breaker may largely include a shaft assembly 20 including a movable contactor 25 and a shaft 21 to which the movable contactor 25 is coupled at one side thereof, a base assembly 30 provided with a contact portion, an extinguisher and a terminal portion including a fixed contactor (not shown) and a movable contactor 25, and a switch mechanism 50 configured to rotate the shaft 21. Here, an entire enclosure of the molded-case circuit breaker is not illustrated.

The base assembly 30 accommodates the movable contactor 25 and fixed contactor to provide a space for accommodating the contact portion to perform breaking of an electrical circuit. The base assembly 30 may be configured with a pair of molds divided into the left and the right. The terminal portions are provided at both end portions of the base assembly 30 in a length direction. Here, a power side (or load side) terminal portion 31 is provided at one end thereof, and a coupling portion 23 coupled to a load side (or power side) terminal portion (not shown) is provided at the other end thereof.

Coupling holes 33, 34 to which the switch mechanism 50 can be coupled are formed in a penetrating manner on a part of the base assembly 30. Couplings pins 38, 39 are coupled in a penetrating manner to the coupling holes 33, 34, respectively.

A mounting portion 35 on which the switch mechanism 50 can be mounted may be formed in a step or a groove shape on both sides of the base assembly 30 in a width direction. The coupling holes 33, 34 may be formed on a part of the mounting portion 35. A link operation portion 36 may be formed in a step or groove shape on a part of the mounting part 35 to operate the first lower link 40 and second lower link 45.

A pinhole 37 that is a space in which the rotating pins 60, 65 which will be described later can be exposed and operated is formed on both sides of the base assembly 30. The pinhole 37 may be provided in a part of the link operation portion 36. The pinhole 37 may be formed in an arc shape. The pinhole 37 may be formed to be larger than an operating space of the rotating pins 60, 65.

The switch mechanism 50 may include a pair of side plates 51 fixed to the base assembly 30, a switch lever 52 rotatably provided on the side plates 51, a handle 53 coupled to an upper portion of the switch lever 52 to transfer a user's power, a main spring 54 elastically operated by the rotation of the handle 53 to transfer power to a link shaft 55, and a first lower link 40 and a second lower link 45 upper ends of which are coupled to the link shaft 55 to move.

Side plate coupling holes 51*a*, 51*b* are formed on the side plates 51, and side plates 51 are inserted and coupled into the base assembly 30 to allow the positions of the side plate coupling holes 51*a*, 51*b* to correspond to the coupling holes 33, 34 of the base assembly 30, and coupling is fixed and maintained by the coupling pins 38, 39 passing through the side plate coupling holes 51*a*, 51*b* and coupling holes 33, 34. Here, the side plates 51 is inserted to surround the mounting portion 35, and the first lower link 40 and second lower link 45 are placed at a position of the pinhole 37 on the link operation portion 36.

The shaft assembly 20 is accommodated into the base assembly 30. The base assembly 30 may include a shaft 21, a movable contactor 25 coupled to one side of the shaft 21, and a terminal coupling portion 23 coupled to the other side of the shaft 21. The terminal coupling portion 23 is fixed to the other end of the base assembly 30, and the shaft 21 is rotatably provided to rotate the movable contactor 25 along with the shaft 21 when turned on or off.

A rotating pinhole 22 into which the rotating pin 60, 65 can be inserted and coupled is formed in a penetrating manner on the shaft 21. The shaft 21 receives a force of the first lower link 40 and second lower link 45 by the rotating pin 60, 65 coupled to the rotating pinhole 22 to move.

The rotating pin 60, 65 may be configured with a first rotating pin 60 and a second rotating pin 65. The first rotating pin 60 and second rotating pin 65 may be formed in the same shape. The first rotating pin 60 and second rotating pin 65 are inserted and coupled into the first lower link 40 and second lower link 45, respectively.

A first protruding portion 61 and a second protruding portion 66 are formed at an outside of the first rotating pin 60 and second rotating pin 65, respectively. The first protruding portion 61 and second protruding portion 66 may be formed to have a larger diameter than a body portion of the first rotating pin 60 and second rotating pin 65. An inner surface 61*a* of the first protruding portion 61 and an inner surface 66*a* of the second protruding portion 66 are brought into contact with the first lower link 40 and second lower link 45.

Referring to FIG. 6, the first rotating pin 60 and second rotating pin 65 are symmetrically provided to each other in such a manner that end portions of the body portion are brought into contact with each other (the first protruding portion 61 and second protruding portion 66 face outward. Accordingly, the first rotating pin 60 and second rotating pin 65 are brought into contact with the first lower link 40 and second lower link 45 to prevent movement so as not to be pulled inward as well as not to be released from the link 40 and second lower link 45.

Referring to FIG. 9, the first lower link 40 and second lower link 45 may be formed in an arc shape. The link shaft coupling holes 41, 46 may be formed at upper ends of the first lower link 40 and second lower link 45, respectively, and the rotating pin coupling holes 42, 47 at lower ends of the first lower link 40 and second lower link 45, respectively.

A first discharge groove 43 and a second discharge groove 48 are formed on a part of the first lower link 40 and second lower link 45, respectively. The first discharge groove 43 and second discharge groove 48 may be formed by cutting a part of a rear portion on which the first lower link 40 and second lower link 45 are formed in a bent shape. Here, inner surfaces of the first discharge groove 43 and second discharge groove 48 may be formed into a convex curved surface.

Referring to FIG. 7, though a part of the pinhole 37 is open by the first discharge groove 43 and second discharge groove 48 of the first lower link 40 and second lower link 45 in an ON state of the circuit breaker to form an exhaust space (B), and most of an arc pressure generated at the time of interruption is discharged through an arc extinguisher and an exhaust portion (A), a part of the residual pressure may be also discharged through the exhaust space (B), thereby reducing a pressure receiving at the first lower link 40 and second lower link 45 due to an arc impact.

According to a mechanism coupling structure of a molded-case circuit breaker in accordance with an embodiment of the present disclosure, a part of an arc pressure generated at the time of interruption may be discharged through a discharge groove on a lower link, thereby having an effect of reducing a pressure acting on the lower link. Furthermore, a rotating pin may have a protruding portion, thereby having an effect of preventing the rotating pin from being released from a lower link even when receiving a force due to an arc pressure.

Figure 10A:
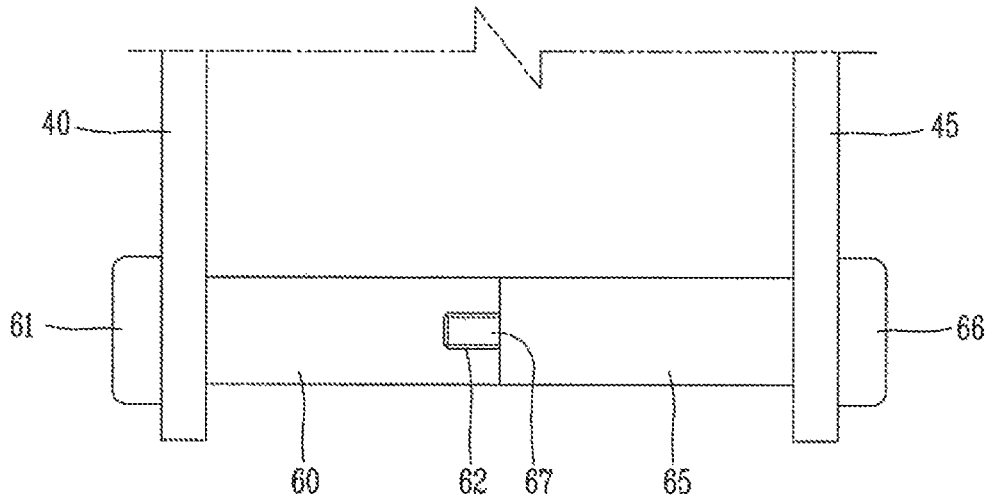
FIGS. 10A and 10B are sectional views illustrating a mechanism coupling structure of a molded-case circuit breaker according to another embodiment of the present invention.
Figure 10B:
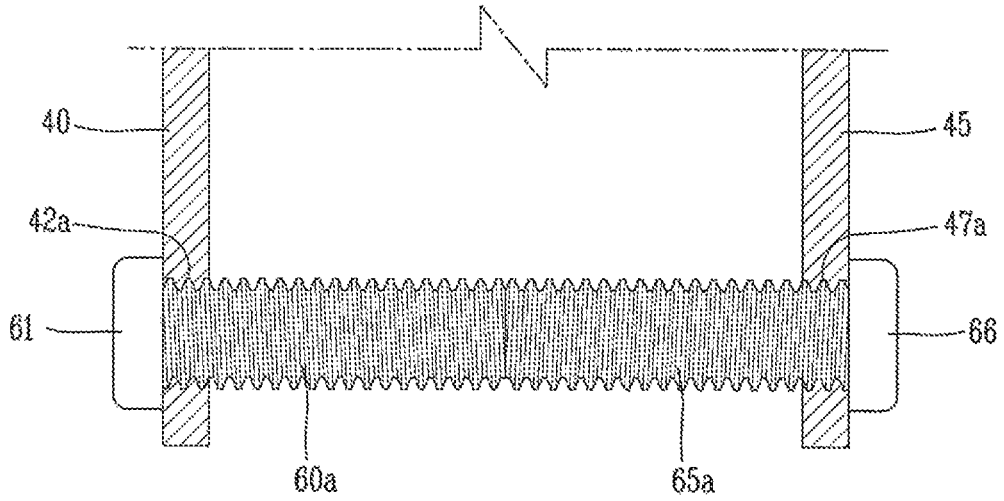

FIGS. 10A and 10B illustrate a mechanism coupling structure of a molded-case circuit breaker according to another embodiment of the present invention. Here, only a portion to which the lower link and the rotating pin are coupled is illustrated.

According to the present embodiment illustrated in FIG. 10A, it is illustrated that a screw groove 62 is formed in a body end portion of the first rotating pin 60, and a screw portion 67 is formed in the body end portion of the second rotating pin 6 to allow the first rotating pin 60 and second rotating pin 65 to be screw-coupled to each other.

According to the present embodiment illustrated in FIG. 10B, it is illustrated that threads are formed on rotating pin coupling holes 42*a*, 47*a* of the first lower link 40 and second lower link 45, and the first rotating pin 60*a* and second rotating pin 65*a* are configured with screws.

According to the embodiments illustrated in FIGS. 10A and 10B, the first rotating pin and second rotating pin may be coupled by screw-coupling, and thus have an excellent coupling force, thereby more effectively preventing the lower link from being released from the rotating pin.

It will be apparent to those skilled in this art that various changes and modifications may be made thereto without departing from the gist of the present invention. Accordingly, it should be noted that the embodiments disclosed in the present invention are only illustrative and not limitative to the concept of the present invention, and the scope of the concept of the invention is not limited by those embodiments. The scope protected by the present invention should be construed by the accompanying claims, and all the concept within the equivalent scope of the invention should be construed to be included in the scope of the right of the present invention.

What is claimed is:

1. A mechanism coupling structure of a molded-case circuit breaker, comprising:

a shaft to one side of which a movable contactor is coupled, and on a part of which a rotating pinhole is formed in a penetrating manner;

a base assembly into which the shaft is rotatably accommodated and coupled;

a switch mechanism coupled to an upper portion of the base assembly and exposed with a first lower link and a second lower link at a lower side thereof; and a rotating pin coupled in a penetrating manner to the first lower link, the second lower link and the rotating pinhole, wherein the rotating pin comprises a first rotating pin having a first protruding portion at one end thereof and a second rotating pin having a second protruding portion at one end thereof, the first protruding portion and the second protruding portion are formed to have a larger diameter than a body portion of the first rotating pin and the second rotating pin respectively, and wherein an inner surface of the first protruding portion and an inner surface of the second protruding portion are brought into contact with the first lower link and the second lower link respectively to prevent separation of the first rotating pin and the second rotating pin.

2. The mechanism coupling structure of a molded-case circuit breaker of claim 1, wherein the first rotating pin and the second rotating pin are symmetrically provided in such a manner that the first protruding portion and the second protruding portion face outward.

3. The mechanism coupling structure of a molded-case circuit breaker of claim 1, wherein an arc-shaped pinhole is formed on the base assembly to expose the rotating pinhole when the shaft rotates, and a discharge groove configured to open a part of the arc-shaped pinhole is formed at a lower portion of the first lower link and the second lower link to discharge an arc pressure generated at the time of interruption to an outside thereof.

4. The mechanism coupling structure of a molded-case circuit breaker of claim 3, wherein the discharge groove is formed by cutting a part of the first lower link and the second lower link.

5. The mechanism coupling structure of a molded-case circuit breaker of claim 1, wherein a screw groove and a screw portion are formed at body end portions of the first rotating pin and the second rotating pin, respectively, to allow the first rotating pin and the second rotating pin to be screw-coupled to each other.

6. The mechanism coupling structure of a molded-case circuit breaker of claim 1, wherein threads are formed on rotating pin coupling holes of the first lower link and the second lower link, and the first rotating pin and the second rotating pin are configured with screws.

* * * * *